US012509841B2

(12) United States Patent
Lambeth et al.

(10) Patent No.: US 12,509,841 B2
(45) Date of Patent: Dec. 30, 2025

(54) MANHOLE MARKER ASSEMBLY

(71) Applicant: Spencer J. Lambeth, Sandy Springs, GA (US)

(72) Inventors: Spencer J Lambeth, Sandy Springs, GA (US); Frank Joseph Sinapi, Oxford, GA (US)

(73) Assignee: Spencer J. Lambeth, Sandy Springs, GA (US)

( * ) Notice: Subject to any disclaimer, the term of this patent is extended or adjusted under 35 U.S.C. 154(b) by 829 days.

(21) Appl. No.: 17/862,535

(22) Filed: Jul. 12, 2022

(65) Prior Publication Data

US 2024/0018738 A1 Jan. 18, 2024

(51) Int. Cl.
*E02D 29/14* (2006.01)

(52) U.S. Cl.
CPC ..... *E02D 29/1481* (2013.01)

(58) Field of Classification Search
CPC ..... E02D 29/12; E02D 29/1481; E01F 13/02; E01F 13/00; E01F 9/60; E01F 9/608; E01F 9/61; E01F 9/658; E01F 9/669; E01F 9/673; E01F 9/692; G09F 7/18
See application file for complete search history.

(56) References Cited

U.S. PATENT DOCUMENTS 457,596 A * 8/1891 Adams ..... E01B 5/16 238/52
1,741,323 A * 12/1929 Lufkin ..... E01F 13/02 52/646
2,099,479 A 11/1937 Heinkel et al.
2,624,307 A * 1/1953 Caffrey ..... G08G 1/096783 49/31
2,942,625 A 6/1960 Costanzo
3,021,601 A * 2/1962 Hayes ..... E01B 35/08 248/214
3,166,041 A 1/1965 Caggainello
3,322,198 A 5/1967 McHenry
3,561,470 A 2/1971 Hawle
3,717,963 A 2/1973 Sauriol
3,728,464 A 4/1973 Griffing
3,746,034 A 7/1973 Cosson
(Continued)

FOREIGN PATENT DOCUMENTS

CA 1272074 A 7/1990
DE 2134941 A1 2/1973
(Continued)

OTHER PUBLICATIONS

American Highway Products, Limited, Locate Street Covers With The I.D. Locator; p. 1,www.ahp1.com, American Highway Products, Limited, Bolivar, Ohio.
(Continued)

*Primary Examiner* — Abigail A Risic
(74) *Attorney, Agent, or Firm* — Thomas B. McGurk

(57) ABSTRACT

A manhole marker assembly for attaching to a manhole cover to identify a manhole comprises a marker assembly base, a marker mounted to the marker assembly base, and a clamp mounted to the marker assembly base. The clamp comprises a first jaw and a second jaw. At least one of the first jaw and the second jaw are movable and can be engaged to a manhole cover to attach the manhole marker assembly to the manhole cover.

19 Claims, 17 Drawing Sheets

(56) References Cited

U.S. PATENT DOCUMENTS

| | | | | |
|---|---|---|---|---|
| 3,927,637 | A | 12/1975 | Sammaritano | |
| 4,275,757 | A | 6/1981 | Singer | |
| 4,325,405 | A | 4/1982 | Christo | |
| 4,534,378 | A | 8/1985 | Gagas | |
| 4,691,892 | A * | 9/1987 | Grewe | E01F 9/627 40/608 |
| 4,709,891 | A * | 12/1987 | Barnett | G09F 7/18 248/231.71 |
| 4,738,060 | A * | 4/1988 | Marthaler | E04H 12/223 52/153 |
| 4,757,595 | A | 7/1988 | Fraering, Jr. | |
| 5,003,735 | A | 4/1991 | Bates | |
| 5,044,303 | A | 9/1991 | Culver, Jr. | |
| 5,063,996 | A | 11/1991 | Kenner | |
| 5,092,556 | A | 3/1992 | Darling et al. | |
| 5,176,408 | A | 1/1993 | Pedersen | |
| 5,195,841 | A | 3/1993 | Mullins | |
| 5,234,280 | A | 8/1993 | Cowan | |
| 5,435,662 | A | 7/1995 | Brown et al. | |
| 5,623,971 | A * | 4/1997 | Foernzler | E03F 5/0407 138/104 |
| 5,642,973 | A | 7/1997 | Pretty | |
| 5,769,565 | A | 6/1998 | Martin, Jr. et al. | |
| 5,878,519 | A * | 3/1999 | Huyck, Jr. | G09F 7/18 40/607.1 |
| 6,032,697 | A | 3/2000 | Kennedy | |
| 6,062,506 | A | 5/2000 | Eck et al. | |
| 6,083,392 | A | 7/2000 | Rigney | |
| 6,109,824 | A | 8/2000 | Annes | |
| 6,164,317 | A | 12/2000 | Hanson | |
| 6,321,679 | B1 | 11/2001 | Murrin | |
| 6,347,600 | B1 * | 2/2002 | Duff, II | G09F 15/0025 40/607.1 |
| 6,354,325 | B1 | 3/2002 | Warnes et al. | |
| 6,378,453 | B1 | 4/2002 | Conway | |
| 6,945,731 | B1 * | 9/2005 | Vait | G09F 17/00 248/560 |
| 7,069,680 | B1 * | 7/2006 | Crawford | G09F 7/18 24/502 |
| 7,117,883 | B1 | 10/2006 | Vitalo | |
| 7,228,813 | B2 | 6/2007 | Flamingo et al. | |
| 7,832,695 | B2 | 11/2010 | Ebel et al. | |
| 8,375,551 | B2 | 2/2013 | Flood, Jr. et al. | |
| 8,757,930 | B2 | 6/2014 | Kiest, Jr. | |
| 8,844,559 | B1 | 9/2014 | Dry | |
| 9,305,475 | B1 * | 4/2016 | White | G09F 15/0062 |
| 9,518,369 | B2 | 12/2016 | Ducote et al. | |
| 9,534,731 | B2 * | 1/2017 | White | F16M 13/02 |
| 10,047,877 | B2 | 8/2018 | Lambeth | |
| 10,344,447 | B2 * | 7/2019 | Sauve | E02D 29/1409 |
| 10,571,046 | B1 | 2/2020 | Lambeth | |
| 11,280,052 | B1 * | 3/2022 | Jensrud | G09F 17/00 |
| D1,009,601 | S * | 1/2024 | Stawychny | D8/354 |
| 2002/0073915 | A1 | 6/2002 | Howard | |
| 2004/0231724 | A1 | 11/2004 | Mahaney | |
| 2008/0142108 | A1 | 6/2008 | Baker et al. | |
| 2008/0307684 | A1 * | 12/2008 | Ulloa | G09F 7/18 40/607.1 |
| 2009/0044869 | A1 | 2/2009 | Brown et al. | |
| 2010/0064563 | A1 * | 3/2010 | Lockhart | E01F 9/608 40/607.1 |
| 2016/0369917 | A1 | 12/2016 | Lambeth | |
| 2017/0167107 | A1 * | 6/2017 | Armstrong | E05B 65/006 |
| 2017/0216996 | A1 * | 8/2017 | Costen | B25B 5/103 |
| 2019/0169806 | A1 * | 6/2019 | Coursey | E01F 9/70 |
| 2024/0167242 | A1 * | 5/2024 | Martínez Mas | E02D 29/1481 |

FOREIGN PATENT DOCUMENTS

| | | | |
|---|---|---|---|
| DE | 2020171021 | U1 | 5/2017 |
| DE | 202012004001 | U1 | 5/2021 |
| EP | 2474671 | A2 | 7/2012 |
| KR | 20020034141 | A | 5/2002 |

OTHER PUBLICATIONS

Geoquip Water Solutions Specialists, Manhole Cover Seal Breaker, p. 1-2; https://www.geoquipwatersolutions.com/mahole-cover-seal-breaker.html, 2021, Geoquip Water Solutions Ltd, Ipswich, Suffolk, UK.

Industrial Magnetics, Inc., Manhole Cover Lift Systems, pp. 1-4, www.magnetics.com, Industrial Magnetics, Inc., Boyne City, Michigan.

Ford Meter Box Company, Inc.; "Ford Type X Single Lid Covers/ Ford PMBC-3 Plastic Meter Box Cover"; www.fordmeterbox.com/ products; Jun. 2015; 2 pages; Ford Meter Box Company, Inc.; Wabash, Indiana, USA.

NDS, Inc.; "Valve and Meter Boxes"; www.ndspro.com; Jun. 2015; 2 pages; NDS, Inc.; Lindsay, California, USA.

City of Lake Oswego Engineering Division; "Typical Sanitary Sewer Cleanout: Drawing No. WW3-01B"; www.ci.oswego.or.us/ publicworks/ww3-01b; 1998; 1 page; City of Lake Oswego; Lake Oswego, Oregon, USA.

City of Lake Oswego Engineering Division; "Typical Sanitary Sewer Cleanout: Drawing No. WW3-01A"; www.ci.oswego.or.us/ publicworks/ww3-01a; 2000; 1 page; City of Lake Oswego; Lake Oswego, Oregon, USA.

The Dobbie Dico Meter Co. (W.A.) Pty Ltd; "Access Ground Covers"; www.dobbie.com.au/node/117; 1 page; The Dobbie Dico Meter Co. (W.A.) Pty Ltd; Malaga, Western Australia.

International Searching Authority/US; "PCT International Search Report: PCT/US2016/038383";PCT/ISA/210; W02016209771; 2016; 4 pages; International Searching Authority/US; Alexandria, Virginia, USA.

International Searching Authority/US; "PCT Written Opinion of the International Searching Authority: PCT/US2016/038383";PCT/ISA/ 210; W02016209771; 2016; 5 pages; International Searching Authority/ US; Alexandria, Virginia, USA.

* cited by examiner

MANHOLE MARKER ASSEMBLY

TECHNICAL HELD

The present disclosure is directed generally to marker assemblies, and, more specifically, to marker assemblies for manholes.

BACKGROUND

Sewer, storm drains and other underground utility lines often contain one or more manholes to allow access to the line interior. These manholes sometimes are located in landscapes that are not routinely maintained, thereby resulting in undergrowth partially covering or otherwise obstructing the view of these manholes. Additionally, during construction of new or existing real estate developments, roadways and other public works, manholes of underground utility systems are sometimes exposed to potential damage from trucks or other heavy equipment. Consequently, there is a need for a system that can potentially provide some protection for and/or identification of the presence of an in-ground utility line.

SUMMARY

The present disclosure encompasses a manhole marker assembly for identifying a manhole, the manhole marker assembly comprising: a marker assembly base comprising a marker assembly base top surface and a marker assembly base bottom surface opposing the marker assembly base top surface; a marker mounted to the marker assembly base, wherein the marker extends upward beyond the marker assembly base top surface; and, a plurality of jaws mounted to the marker assembly base, wherein the plurality of jaws comprises a first jaw and a second jaw, wherein each of the first jaw and the second jaw extends downward beyond the marker assembly base bottom surface, wherein at least one of the first jaw and the second jaw are movable, wherein the manhole marker assembly is movable between a manhole cover attached alignment and a manhole cover detached alignment, wherein the manhole marker assembly is attached to a manhole cover in the manhole cover attached alignment, wherein the marker assembly base bottom surface is aligned on a manhole cover in the manhole cover attached alignment, wherein the first jaw and the second jaw engage the manhole cover in the manhole cover attached alignment.

In one aspect, the first jaw is movably connected to the second jaw by a turnbuckle. In another aspect, the first jaw and the second jaw are movable. In a further aspect, the first jaw comprises a tooth. In yet another aspect, the marker assembly base is disposed between the first jaw and the second jaw. In still a further aspect, the marker is pivotally movable. In another aspect, the marker comprises a spring. In one aspect, the marker is aligned above the manhole cover in the manhole cover attached alignment. In a further aspect, the marker assembly base comprises a movable top plate.

The present disclosure also encompasses a manhole marker assembly for attaching to a manhole cover and for marking a manhole, the manhole marker assembly comprising: a marker assembly base; a marker mounted to the marker assembly base, wherein the marker comprises a marker body, wherein the marker body is elongated, wherein the marker body comprises a marker body top and a marker body bottom, wherein the marker body top is aligned distal to the marker assembly base and the marker body bottom is aligned proximal to the marker assembly base, and wherein the marker body is pivotally movable; and, a clamp mounted to the marker assembly base, wherein the clamp comprises a first jaw assembly mounted to the marker assembly base and a second jaw assembly mounted to the marker assembly base, wherein the first jaw assembly comprises a first jaw and the second jaw assembly comprises a second jaw, wherein the first jaw and the second jaw are movable.

In one aspect, the marker assembly base comprises a base top deck and a base skirt depending from the base top deck. In another aspect, the first jaw and the second jaw are extendable from the marker assembly base. In a further aspect, the first jaw assembly comprises a first jaw rod movably connected to the marker assembly base, and wherein the first jaw is mounted on the first jaw rod. In still another aspect, the first jaw rod is aligned in a jaw rod channel formed in the marker assembly base. In one aspect, the first jaw assembly comprises a coupling nut threadably attached to the first jaw rod. In another aspect, the first jaw is aligned opposing the second jaw, and wherein the marker assembly base is aligned between the first jaw and the second jaw. In still a further aspect, the first jaw comprises a first tooth and the second jaw comprises a second tooth. In another aspect, the clamp comprises a turnbuckle connecting the first jaw assembly to the second jaw assembly. In a further aspect, the marker comprises a marker pivot assembly, wherein the marker pivot assembly comprises a marker spring operably connected to the marker body.

The present disclosure also encompasses a manhole marker assembly for attaching to a manhole cover and marking a manhole, the manhole marker assembly comprising: a marker assembly base comprising a base top deck and a base skirt depending from the base top deck, and wherein the base skirt is frustoconical; a marker mounted to the marker assembly base, wherein the marker comprises a marker body, wherein the marker body comprises a marker body top and a marker body bottom, wherein in the marker body top is aligned distal to the base top deck and the marker body bottom is aligned proximal to the base top deck, wherein the marker comprises a marker pivot assembly, wherein the marker body is mounted to the marker pivot assembly, wherein the marker body is pivotally movable on the marker pivot assembly; and, a clamp mounted to the marker assembly base, wherein the clamp comprises a first jaw assembly and a second jaw assembly, wherein the first jaw assembly comprises a first jaw mounted on a first jaw rod, wherein the first jaw rod is movably aligned within a first jaw rod channel formed in the marker assembly base, wherein the second jaw assembly comprises a second jaw mounted on a second jaw rod, wherein the second jaw rod is movably aligned with a second jaw rod channel formed in the marker assembly base, wherein the first jaw rod is adjustably extendable from the first jaw rod channel, and wherein the second jaw rod is adjustably extendable from the second jaw rod channel.

These and other aspects of the present disclosure are set forth in greater detail below and in the drawings for which a brief description is provided as follows.

DETAILED DESCRIPTION

Figure 1:
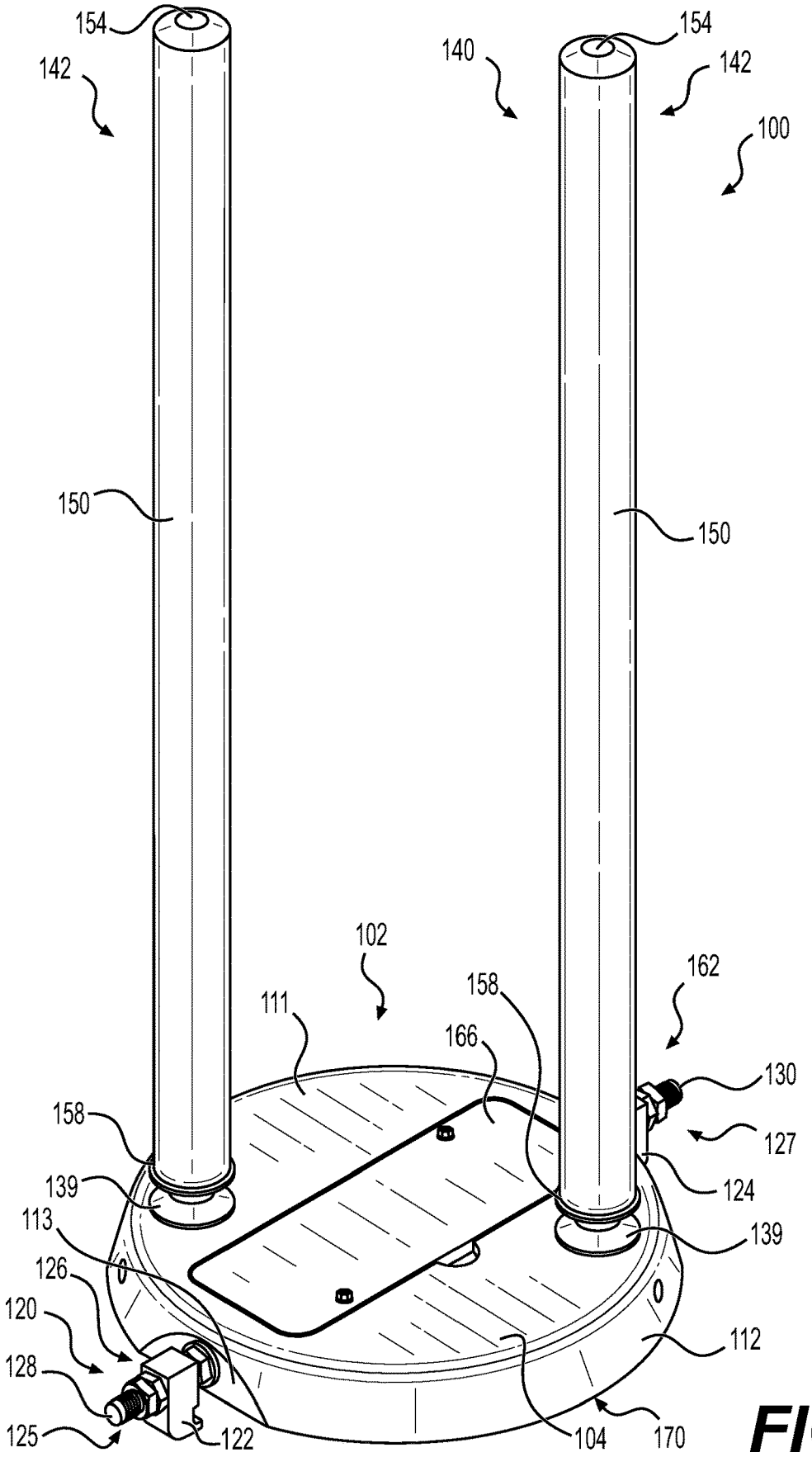
FIG. 1 is a perspective view of a manhole marker assembly for attachment to a manhole cover and marking of a manhole, wherein the manhole marker assembly encompasses aspects of the present disclosure, and wherein the manhole marker assembly is in a manhole cover detached alignment.

The present disclosure encompasses devices and assemblies that can be attached to manhole covers to identify the location of the manholes on which the manhole covers are positioned. The manhole marker assemblies described herein can be used to cover and/or to identify manholes of in-ground utility lines, such as sewer lines, storm water lines, and other such in-ground and/or in-road utility lines. The manhole marker assemblies encompassed by the present disclosure can provide identification of particular manholes when necessary, such as during the construction phase of new development projects or renovations of existing construction. The manhole marker assemblies encompassed by the present disclosure comprise components that are movably connectable to each other so as to allow different configurations of the manhole marker assembly to be assembled for use in varying conditions. Wherever possible, the application uses the same reference numbers throughout the drawings to refer to the same or similar items.

As used herein, the singular forms of "a," "an," and "the" encompasses the plural form thereof unless otherwise indicated. As used herein, the phrase "at least one" includes all numbers of one and greater. As used herein, the term "plurality" includes numbers of two or more. As used herein, the term "connected" encompasses configurations of elements that are attached to or otherwise engaged with each other either directly or indirectly through intermediate components. As used herein, the term "removably mounted" encompasses configurations of elements such that one element or portion thereof optionally can be directly or indirectly mounted on, removed from and/or remounted on another element in the normal course of use of the elements. As used herein, the term "operably connected" encompasses configurations of elements wherein one element is connected directly and/or indirectly to another element so as to allow the two elements to function in the intended fashion within the apparatus. As used herein, the term "in communication" encompasses direct and/or indirect opening or passage between one element and another element during at least some time periods during use.

FIGS. 1-9 illustrate a manhole marker assembly 100 encompassing aspects of the present disclosure. The manhole marker assembly 100, shown in FIGS. 1 and 2, comprises a marker assembly base 102 to which is operably connected a plurality of markers 140. A clamp 120 is operably connected to the marker assembly base 102. The clamp 120 comprises a plurality of jaw assemblies 126 that are movable relative to the marker assembly base 102 and are used to attach the manhole marker assembly 100 to a manhole cover 101 to effectuate a manhole cover attached alignment 160. The marker assembly base 102 is configured to be aligned over and/or be seated upon a manhole cover 101 when used to mark a manhole.

The markers 142 of the plurality of markers 140 are configured to extend upward beyond a marker assembly base top surface 104 of the marker assembly base 102 so as to be visible well beyond the manhole 101 on which the manhole marker assembly 100 is mounted in a manhole cover attached alignment 160. The markers 142 serve as visual identifiers for the location and/or type of manhole over which the manhole cover 101 is disposed. As shown in FIGS. 3-7, the manhole marker assembly 100 can be mounted on a manhole cover 101 to reduce the probability that the manhole is inadvertently struck by vehicles or other equipment and to expedite locating of the manhole and/or identifying the type of utility line in which the marked manhole is formed.

Figure 2:
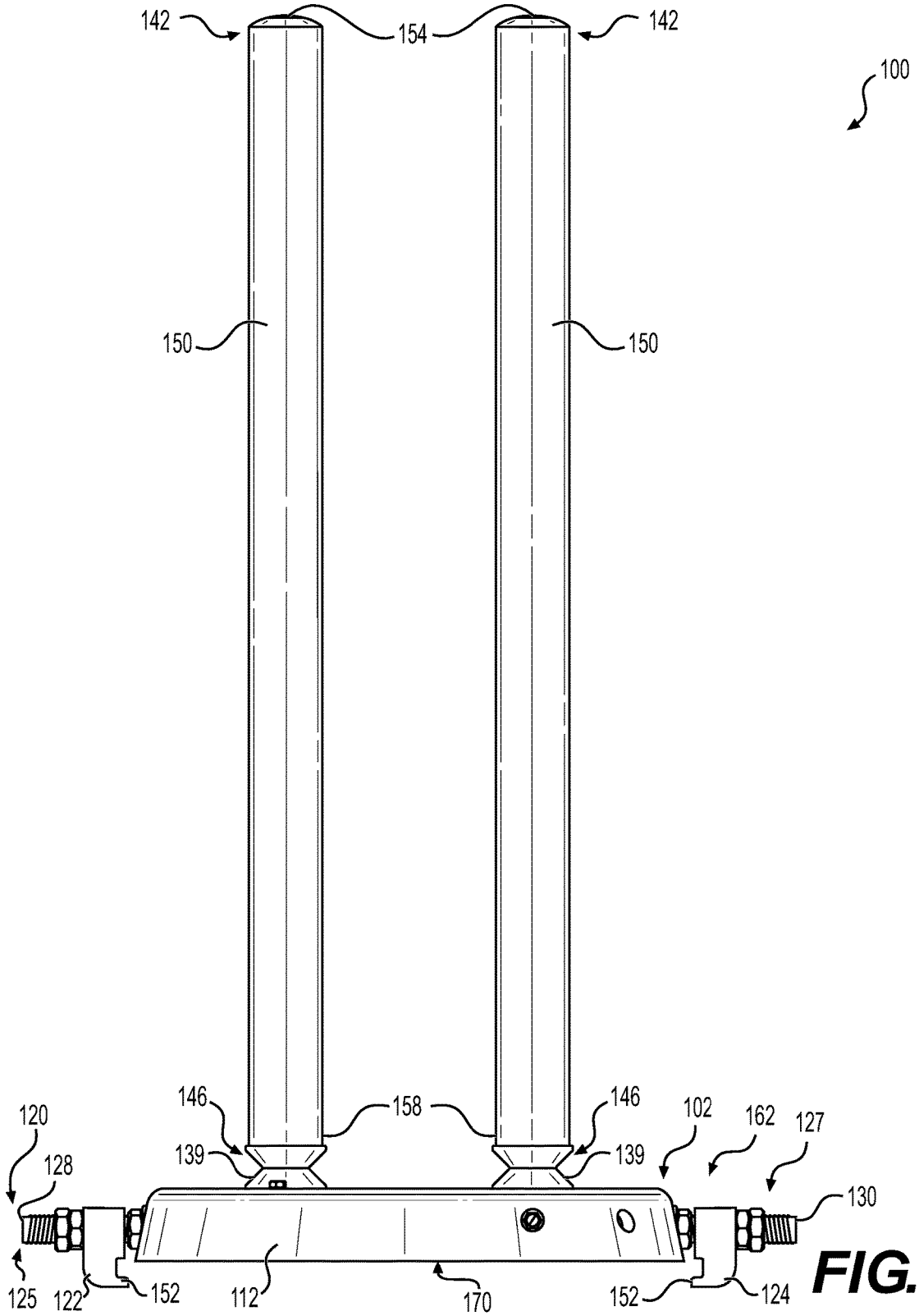
FIG. 2 is a side elevation view of the manhole marker assembly of FIG. 1.
Figure 3:
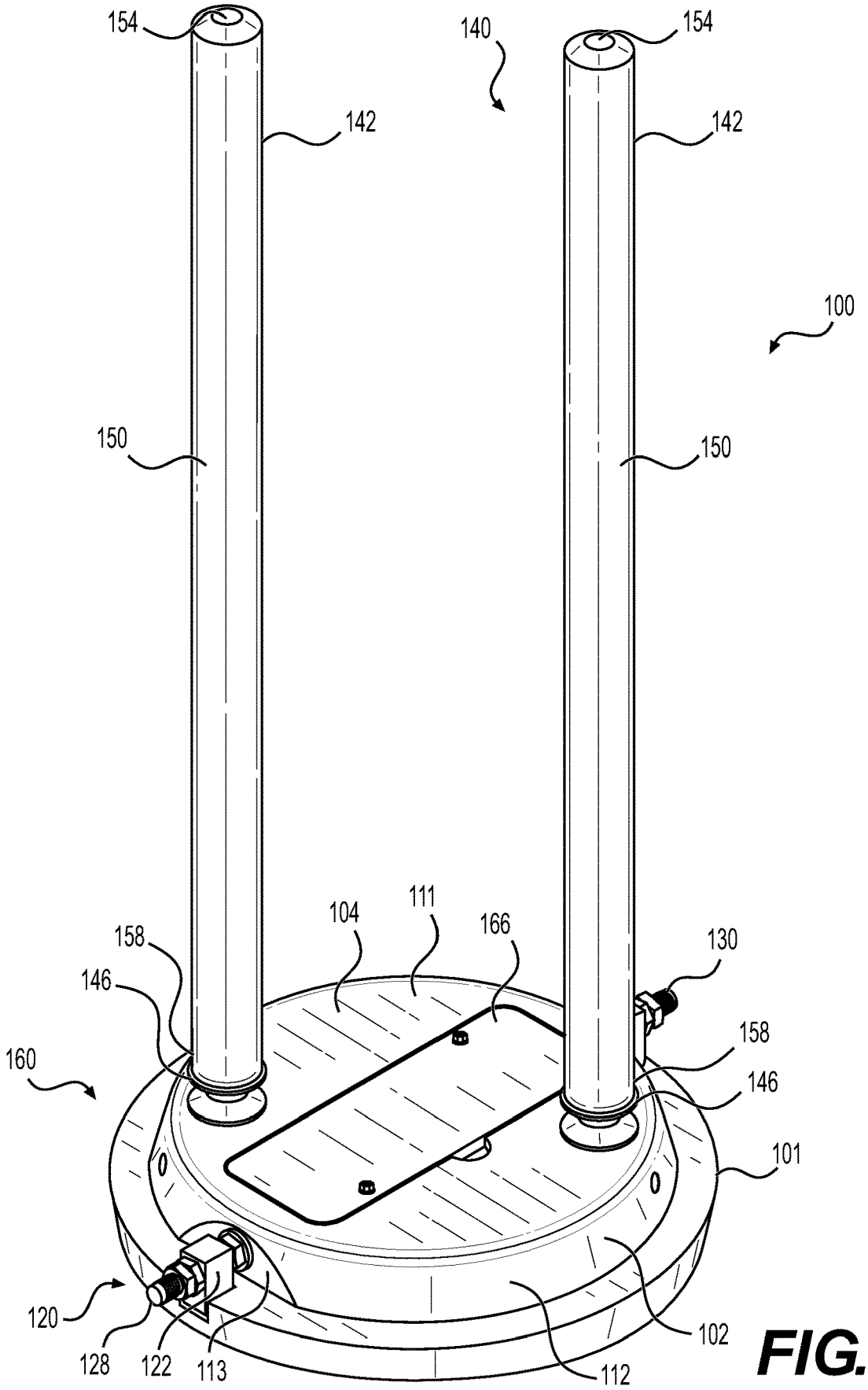
FIG. 3 is a perspective view of the manhole marker assembly shown in FIG. 1 with the manhole marker assembly attached to a manhole cover in a manhole cover attached alignment.
Figure 4:
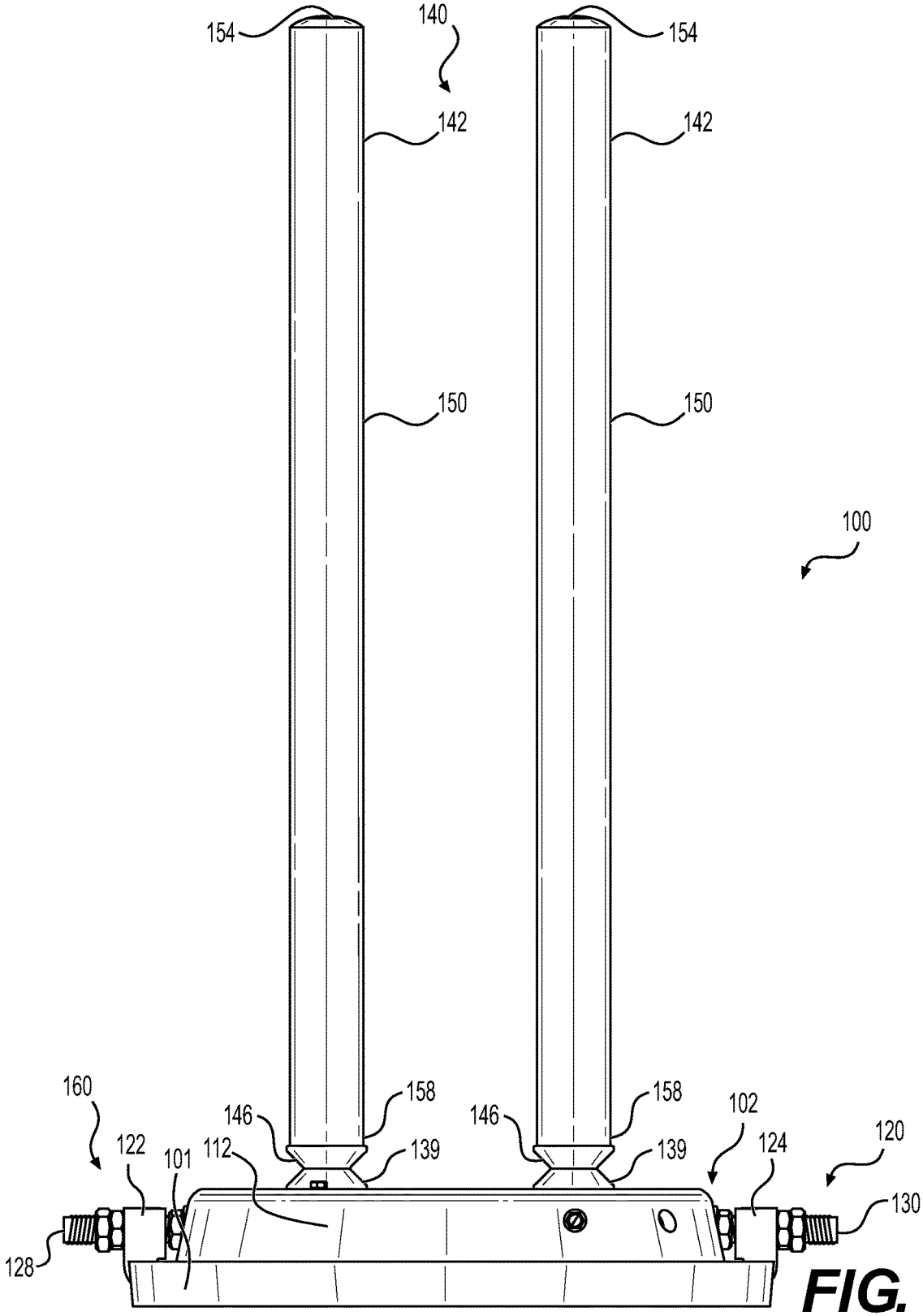
FIG. 4 is a side elevation view of the manhole marker assembly and the manhole cover in the manhole cover attached alignment shown in FIG. 3.
Figure 5:
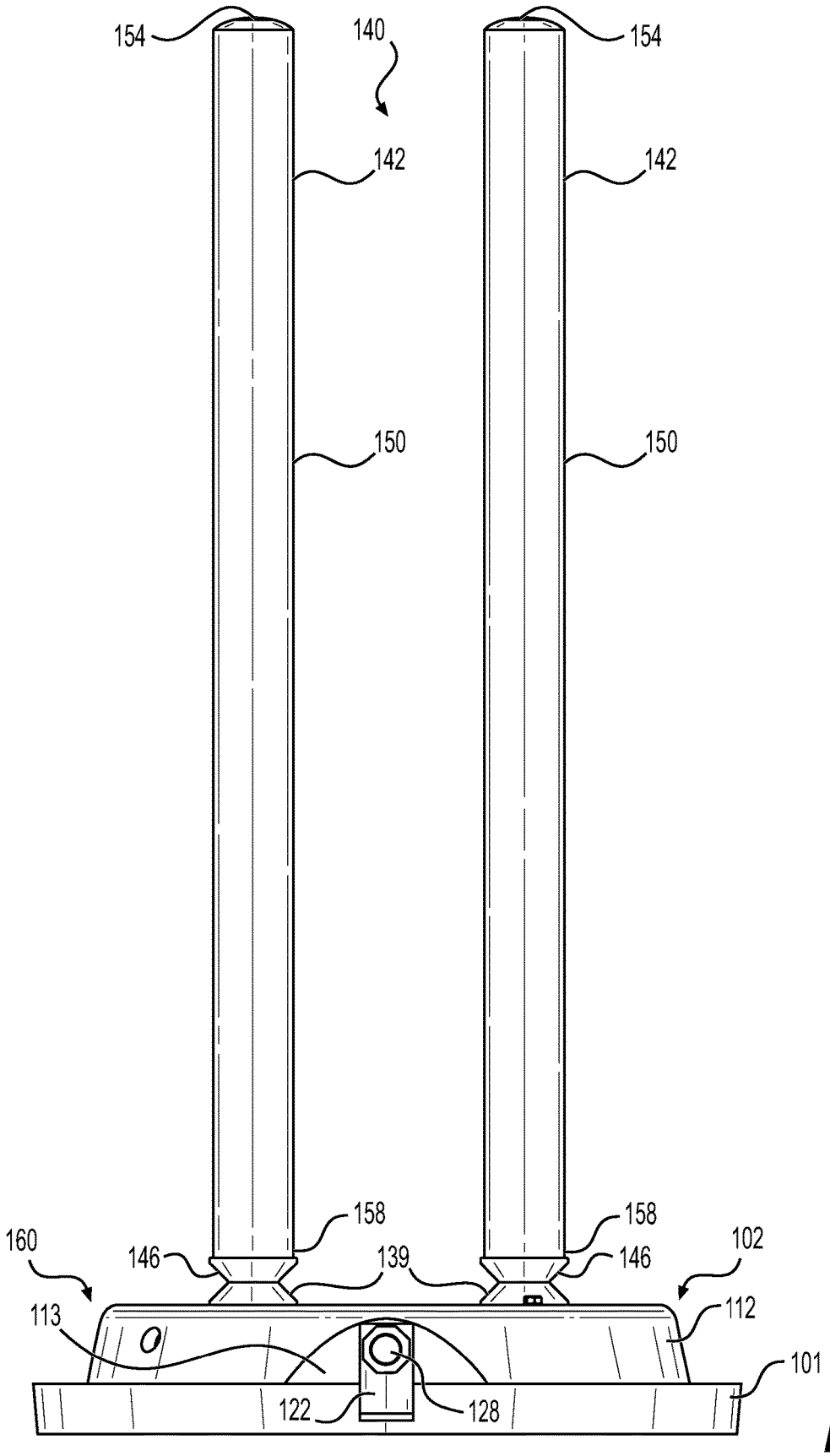
FIG. 5 is another side elevation view of the manhole marker assembly and the manhole cover in a manhole cover attached alignment shown in FIG. 4.

The manhole marker assembly 100 comprises one or more markers 142. As shown in FIGS. 1 and 2, the manhole marker assembly 100 comprises a plurality of markers 140 that includes a pair of markers 142. The present disclosure encompasses manhole marker assemblies comprising pluralities of markers that include more than two markers 142. Each of the markers 142 comprises a marker base 146 supporting a marker body 150. The marker body 150 is elongated and can comprise a hollow tube. The manhole marker assembly 100 is shown in FIGS. 1 and 2 in a detached alignment 162, wherein the manhole marker assembly 100 is not attached to a manhole cover.

The marker assembly base 102 is generally circular and comprises a base top deck 111 from which depends a base skirt 112. The base top deck 111 is generally circular and flat, and the base skirt 112 is generally frustoconical with one or more flat base skirt side walls 113 formed therein. In one aspect, the base skirt 112 can comprise a plurality of base skirt side walls 113.

Figure 7:
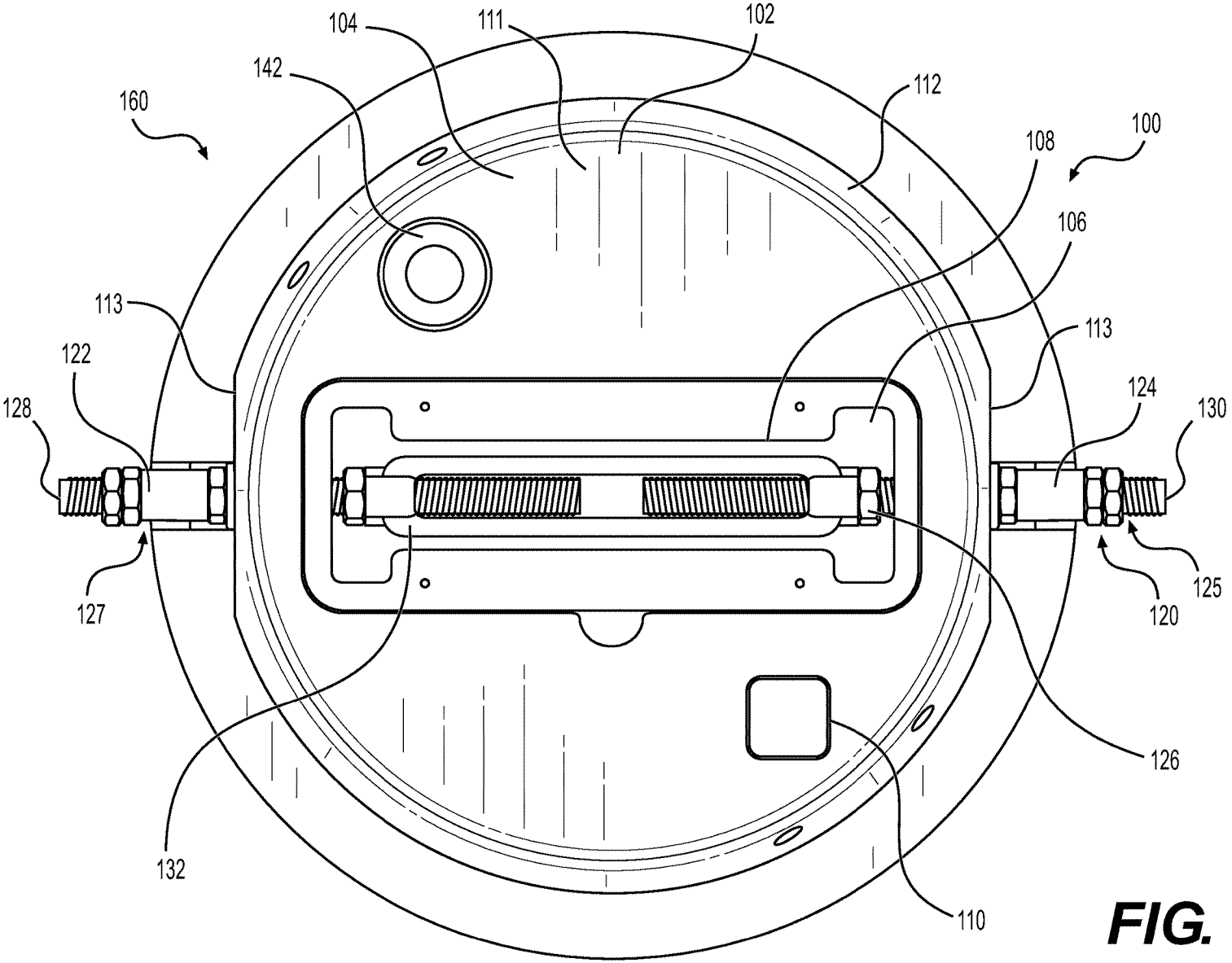
FIG. 7 is another top view of the manhole marker assembly and the manhole cover shown in FIG. 6 with the cover plate removed from the marker assembly base.

The base top deck 111 of the marker assembly base 102 comprises a marker assembly base top surface 104. Each marker 142 of the plurality of markers 140 extends upward beyond the top surface 104 of the base top deck 111 of the marker assembly base 102. As shown in FIG. 7, the base top deck 111 comprises a lip 108 that defines a base access port 106 that provides access into the interior of the marker assembly base 102. A base cover plate 166 can be movably and/or detachably mounted to the marker assembly base 102 to cover the base access port 106. The base cover plate 166 is movable back and forth from a closed alignment, wherein the base cover plate 166 covers the base access port 106, to an open alignment, wherein the base access port 106 is opened. The base cover plate 166 can be attached to the marker assembly base 102 by a plurality of fasteners, such as a plurality of screws threadably connecting the base cover plate 166 to the marker assembly base 102.

Figure 8:
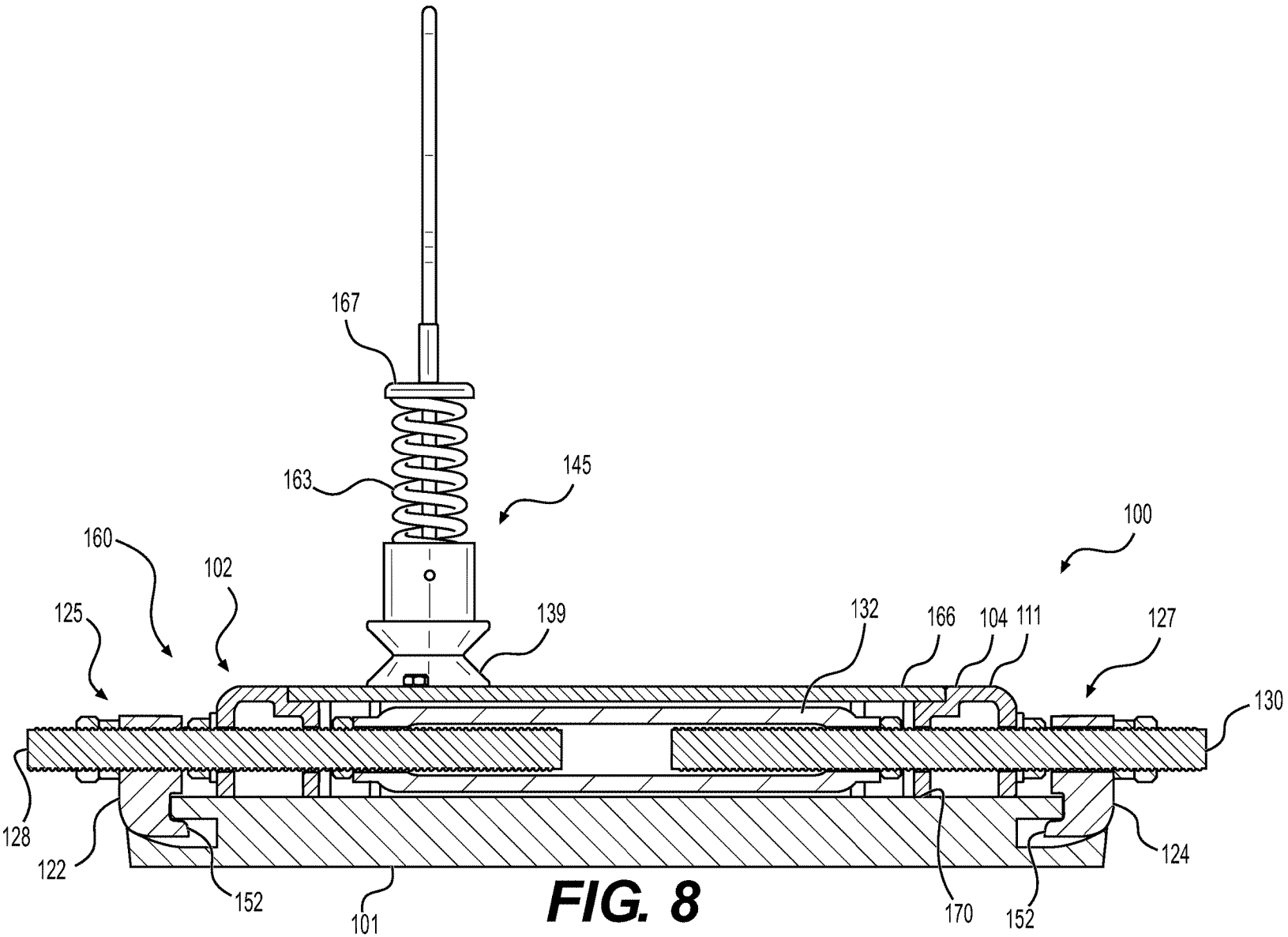
FIG. 8 is a cross-sectional view of the manhole marker assembly and the manhole cover shown in FIG. 6 taken along line 8-8 and with the marker body removed from the manhole marker assembly.
Figure 9:
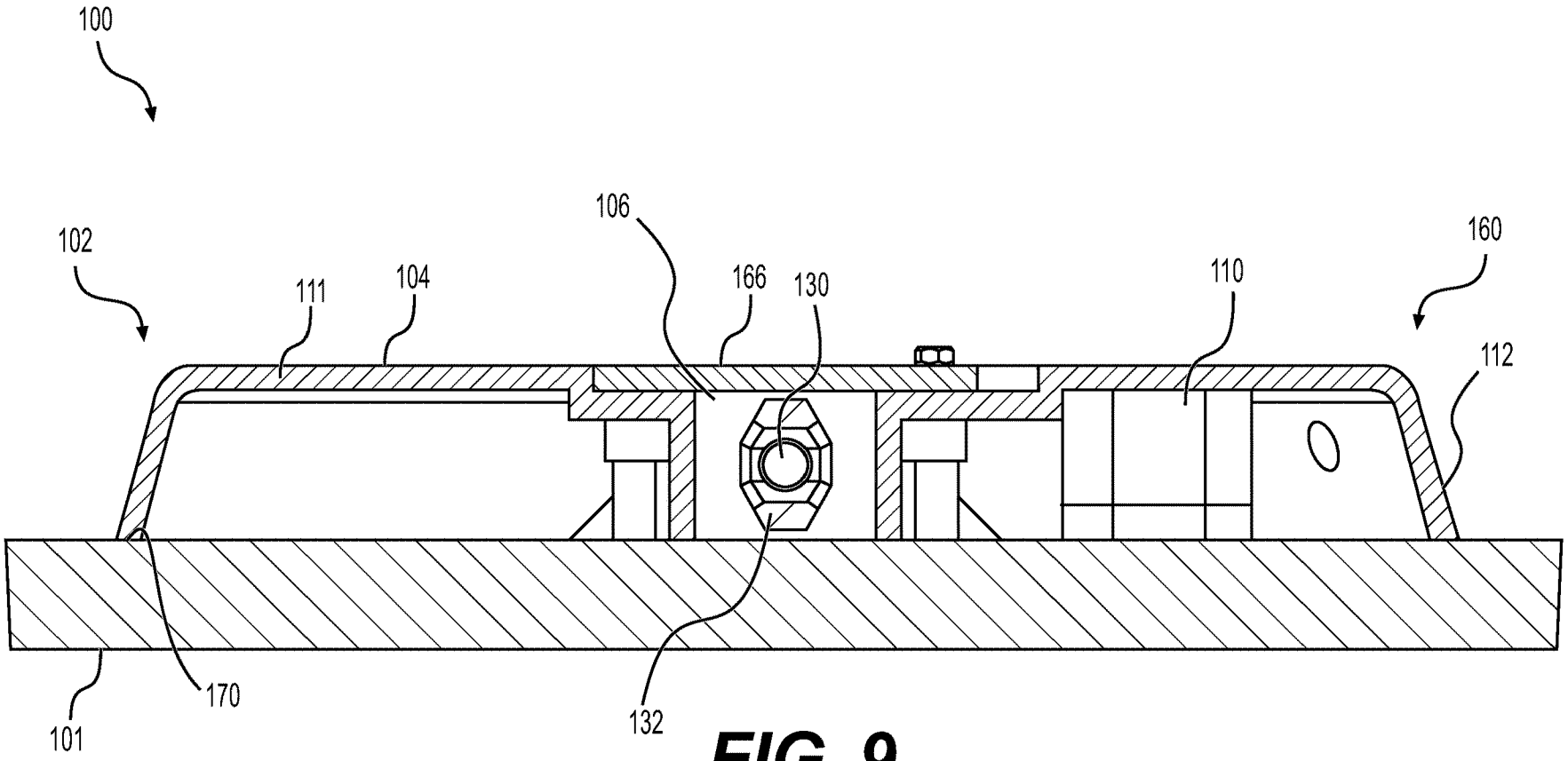
FIG. 9 is another cross-sectional view of the manhole marker assembly and the manhole cover shown in FIG. 6 taken along line 9-9.
Figure 10:
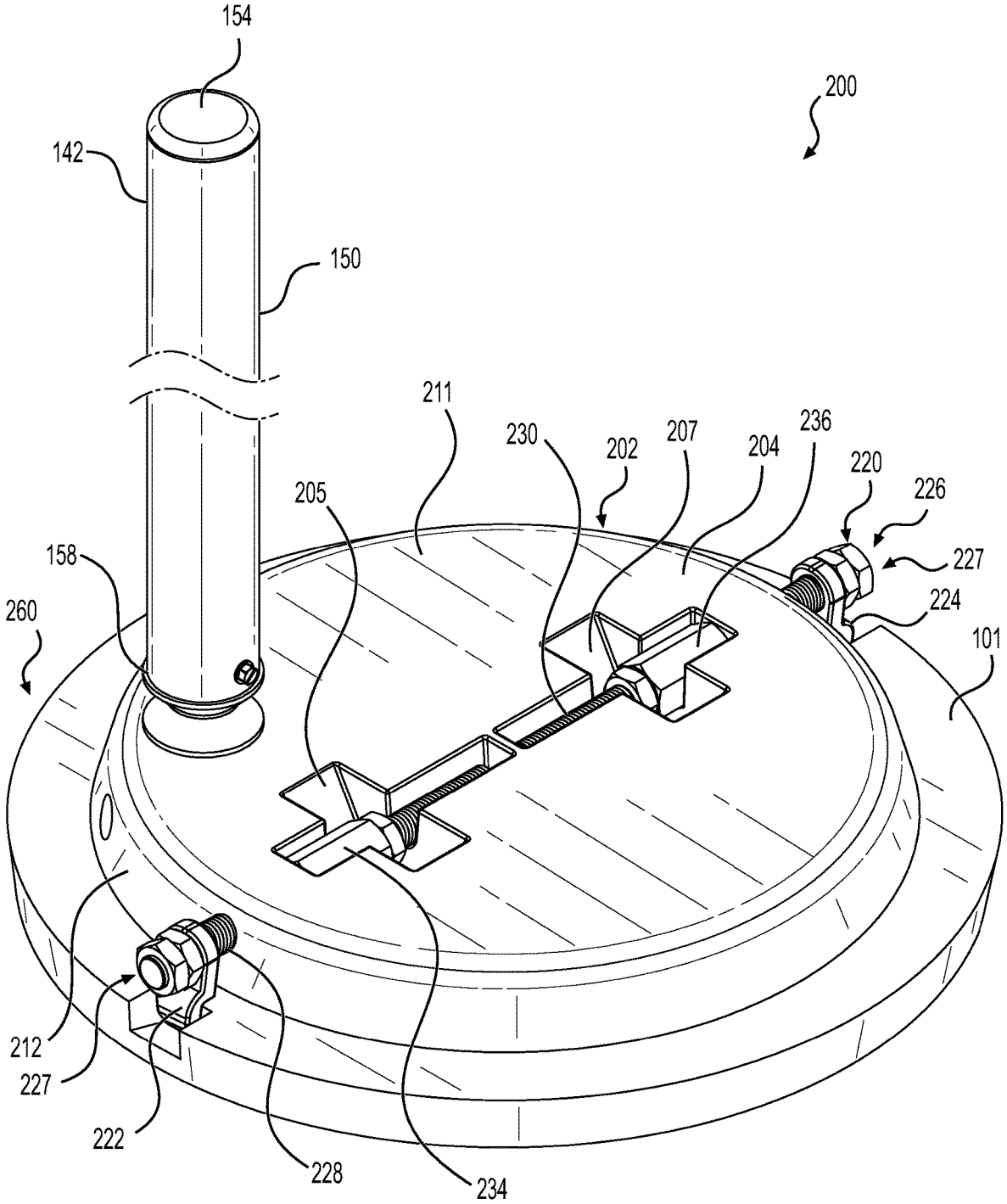
FIG. 10 is a perspective view of another manhole marker assembly encompassing aspects of the present disclosure, wherein the manhole marker assembly is attached to a manhole cover in a manhole cover attached alignment and a portion of the marker body is cutaway.
Figure 11:
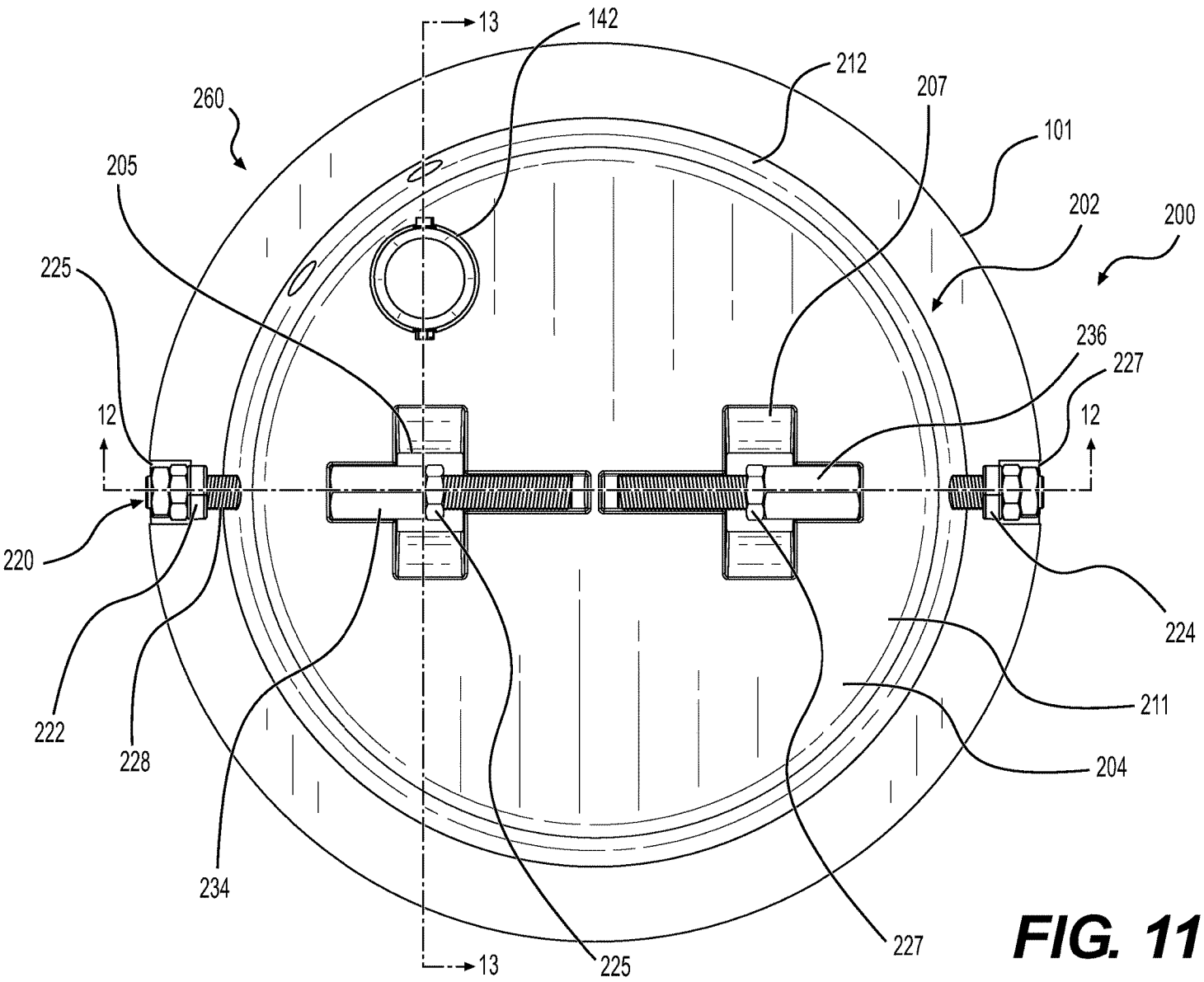
FIG. 11 is a top view of the manhole marker assembly and the manhole cover shown in FIG. 10.
Figure 12:
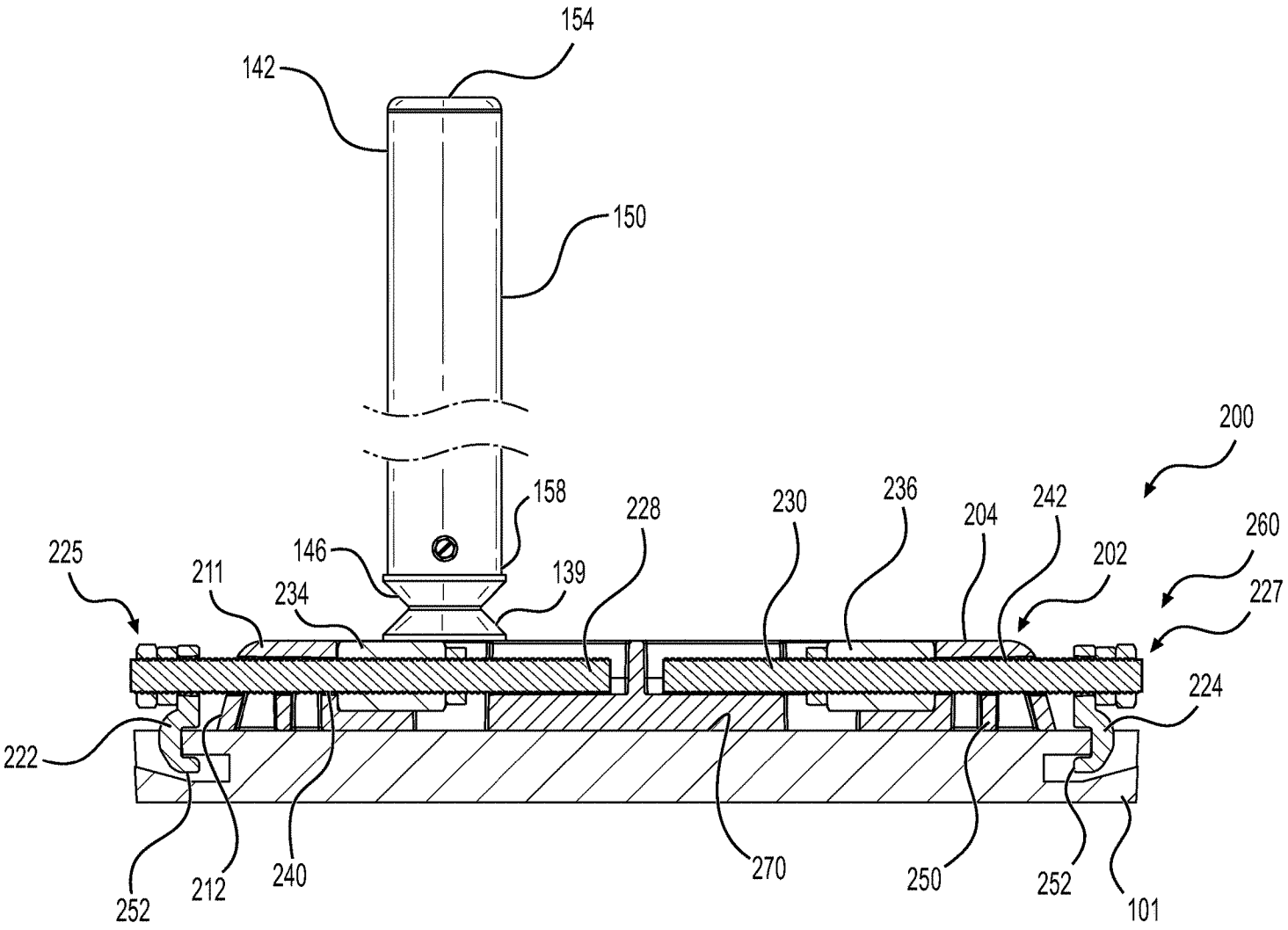
FIG. 12 is a cross-sectional view of the manhole marker assembly and the manhole cover shown in FIG. 11 taken along sight line 12-12, and wherein a portion of the marker is cutaway.

As shown in FIG. 8, the marker assembly base 102 comprises a marker assembly base bottom surface 170 opposing the marker assembly base top surface 104 formed by the base top deck 111. The marker assembly base bottom surface 170 is formed by the base skirt 112 and the other structural components of the marker assembly base 102 that lie within the same plane as to the bottom surface of the base skirt 112. The marker assembly bottom surface 170 rests upon the top surface of the manhole cover 101 when the manhole marker assembly 100 is configured in the manhole cover attached alignment 160.

Figure 6:
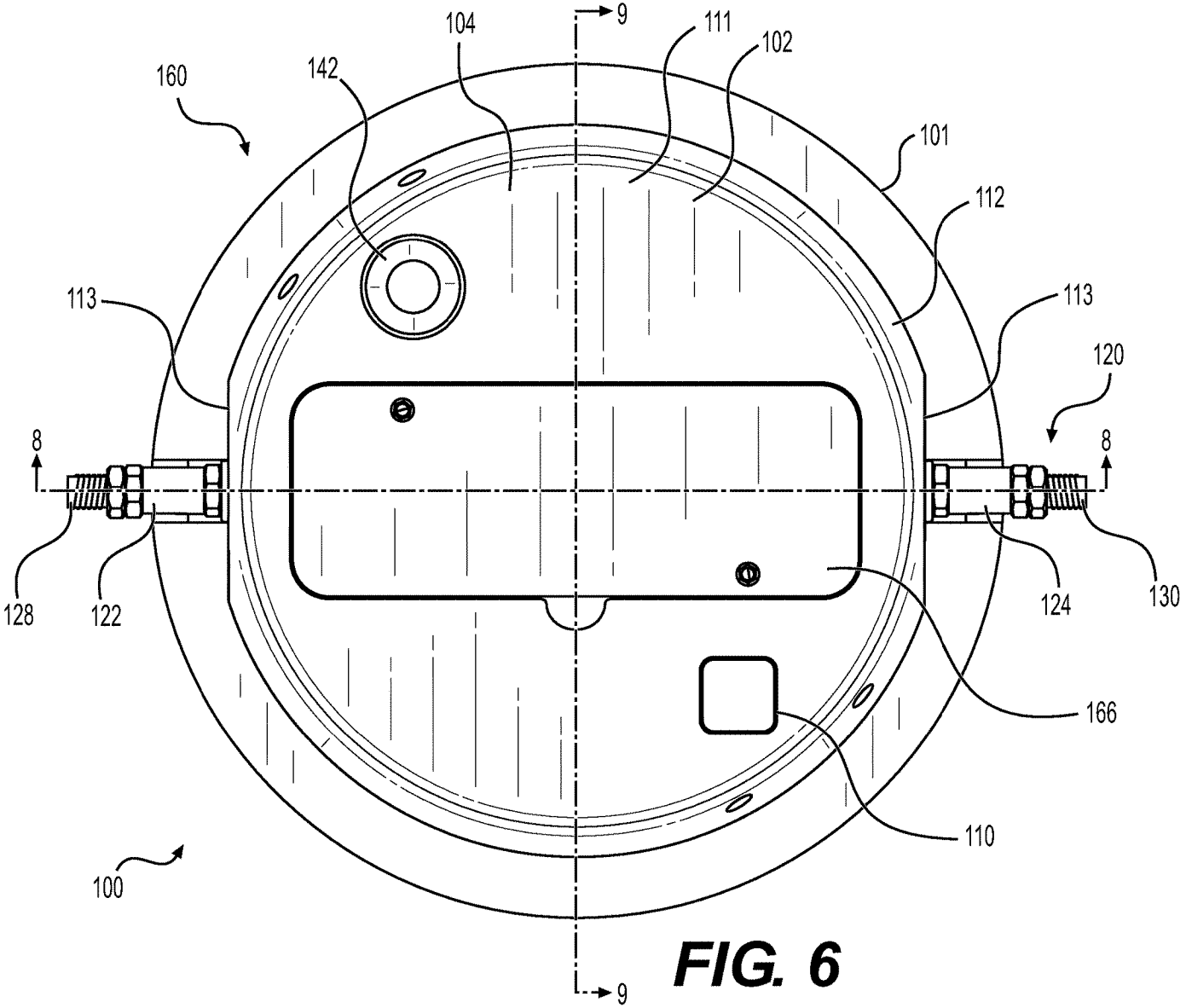
FIG. 6 is a top view of the manhole marker assembly and the manhole cover shown in FIG. 4 with one of the markers removed from the marker assembly base.

The marker assembly base 102 comprises one or more base marker seats 110, as shown in FIGS. 6 and 7. Each base marker seat 110 can comprise an opening formed in the base top deck 111 and a seat wall that depends from the base top deck 111. The base marker seat 110 is configured to receive a marker base 146 of a marker 142. One or more fastener channels can be defined in the seat wall. Each seat fastener channel can be axially aligned with a base skirt fastener channel defined in the base skirt 112. Each of the aligned pairs of fastener channels and base skirt fastener channels can receive a fastener, such as a screw, that can engage the marker base 146 disposed therein, thereby securing the marker base 146 to the marker assembly base 102.

The manhole marker assembly 100 comprises a clamp 120 mounted to the marker assembly base 102 and configured to secure the manhole marker assembly 100 to a manhole cover 101 of a manhole. The clamp 120 comprises a first jaw assembly 125 and a second jaw assembly 127. Each of the first jaw assembly 125 and the second jaw assembly 127 are movably mounted to the marker assembly base 102.

The first jaw assembly 125 comprises a first jaw 122 mounted on a first jaw rod 128. The first jaw 122 is aligned adjacent the base skirt 112 of the marker assembly base 102. The first jaw rod 128 is threaded and movably aligned within an opening in one of the base skirt side walls 113. The first jaw rod 128 is disposed within the marker assembly base 102 and projects out of the base skirt side wall 113. The first jaw 122 is threadably attached to the first jaw rod 128 and positioned outside of and adjacent to the marker assembly base 102. A portion of the first jaw rod 128 is aligned within the base access port 106 formed within the marker assembly base 102.

The second jaw assembly 127 comprises a second jaw 124 mounted on a second jaw rod 130. The second jaw 124 is aligned adjacent the base skirt 112 of the marker assembly base 102 and opposing the first jaw 122. The second jaw rod 130 is threaded and movably aligned within an opening formed in the opposing base skirt side walls 113. A portion of the second jaw rod 130 is also aligned within the base access port 106. Both of the first jaw rod 128 and the second jaw rod 130 are threadably attached to a turnbuckle 132 that is disposed within the base access port 106. The first jaw rod 128 is threadably attached to a first end of the turnbuckle 132, and the second jaw rod 130 is threadably attached to a second end of the turnbuckle 132. The first jaw assembly 125 and the second jaw assembly 127 are thereby connected to each other by the turnbuckle 132.

The first jaw 122 and the second jaw 124 can be moved alternatively towards and away from the marker assembly base 102 by rotating the turnbuckle 132. Rotating the turnbuckle 132 in a first direction causes the first jaw rod 128 and the second jaw rod 130 to move outward, thereby moving or extending the first jaw 122 and the second jaw 124 away from the marker assembly base 102. Rotating the turnbuckle 132 in the opposite direction causes the first jaw rod 128 and the second jaw rod 130 to move inward or retract, thereby moving or retracting the first jaw 122 and the second jaw 124 towards the marker assembly base 102.

Each of the first jaw 122 and the second jaw 124 comprise a tooth 152. The first jaw 122 and the second jaw 124 and the teeth 152 are configured to engage pick notches formed in the manhole cover 101. Engagement of the pick notches by the first jaw 122, the second jaw 124, and the teeth 152 of the jaws thereby attaches or secures the manhole marker assembly 100 to the manhole covers 101 to form a manhole cover attached alignment 160, as shown in FIGS. 4-8. The engagement of the first jaw 122 and the second jaw 124 to the manhole cover 101 prevents the marker assembly 100 from moving or detaching from the manhole cover 101. Detachment of the marker assembly 100 from the manhole cover 101 is effectuate by threadably extending the first jaw rod 128 and the second jaw rod 130 outward from the marker assembly base 102, thereby moving the first jaw 122 and the second jaw 124 outward from the manhole cover 101.

FIGS. 10-17 illustrate another example of a manhole marker assembly 200 encompassing aspects of the present disclosure. The manhole marker assembly 200 comprises a marker assembly base 202 to which is mounted a single marker 142. The manhole marker assembly 200 includes a clamp 220 that comprises a first jaw assembly 225 and a second jaw assembly 227. Unlike the first jaw assembly 125 and the second jaw assembly 127 of the clamp 120, the first jaw assembly 225 and the second jaw assembly 227 of the clamp 220 are not connected by a turnbuckle. Instead, the first jaw assembly 225 and the second jaw assembly 227 are separately mounted to the marker assembly base 202 of the manhole marker assembly 200.

The first jaw assembly 225 comprises a first jaw 222 mounted on a first jaw rod 228. The first jaw 222 is aligned adjacent the base skirt 212 of the marker assembly base 202. The first jaw rod 228 is threaded and movably aligned within a first jaw rod channel 240 formed within the marker assembly base 202. The first jaw rod channel 240 extends through the base skirt 212 and is open to the outside thereof. The first jaw rod channel 240 is radially aligned within the marker assembly base 202. The first rod channel 240 opens to a first base access port 205 formed within the marker assembly base 202. The first base access port 205 is open to the base top deck 211 of the marker assembly base 202 and has aligned therein a portion of the first jaw rod 228 and a first coupling nut 234 that is threadably attached to the first jaw rod 228. The first base access port 205 allows access to the first coupling nut 234, which can be threadably adjusted so as to move the first jaw rod 228 either inward or outward, thereby extending or retracting first jaw 222.

The second jaw assembly 227 comprises a second jaw 224 mounted on a second jaw rod 230. The second jaw 224 is aligned adjacent the base skirt 212 of the marker assembly base 202 and opposing the first jaw 222. The second jaw rod 230 is threaded and movably aligned within a second jaw rod channel 242 formed within the marker assembly base 202. The second jaw rod channel 242 extends through the base skirt 212 opposite to the position of the opening of the first jaw rod channel 240 within the base skirt 212. The second jaw rod channel 242 is radially aligned within the marker assembly base 202 and linearly aligned with the first jaw rod channel 240. The second rod channel 240 opens to a second base access port 207 formed within the marker assembly base 202. The second base access port 207 is open to the base top deck 211 of the marker assembly base 202 and has aligned therein a portion of the second jaw rod 230 and a second coupling nut 236 that is threadably attached to the second jaw rod 230. The second base access port 207 allows access to the second coupling nut 236, which can be threadably adjusted so as to move the second jaw rod 230, thereby extending or retracting the second jaw 224.

Each of the first jaw 222 and the second jaw 224 comprises a tooth 252. The first jaw 222 and the second jaw 224 and the teeth 252 are configured to engage pick notches formed in the manhole covers 101 and 201. Engagement of the pick notches by the first jaw 222, the second jaw 224, and the teeth 252 of the jaws thereby attach the manhole marker assembly 200 to the respective manhole covers 101 or 201.

Figure 13:
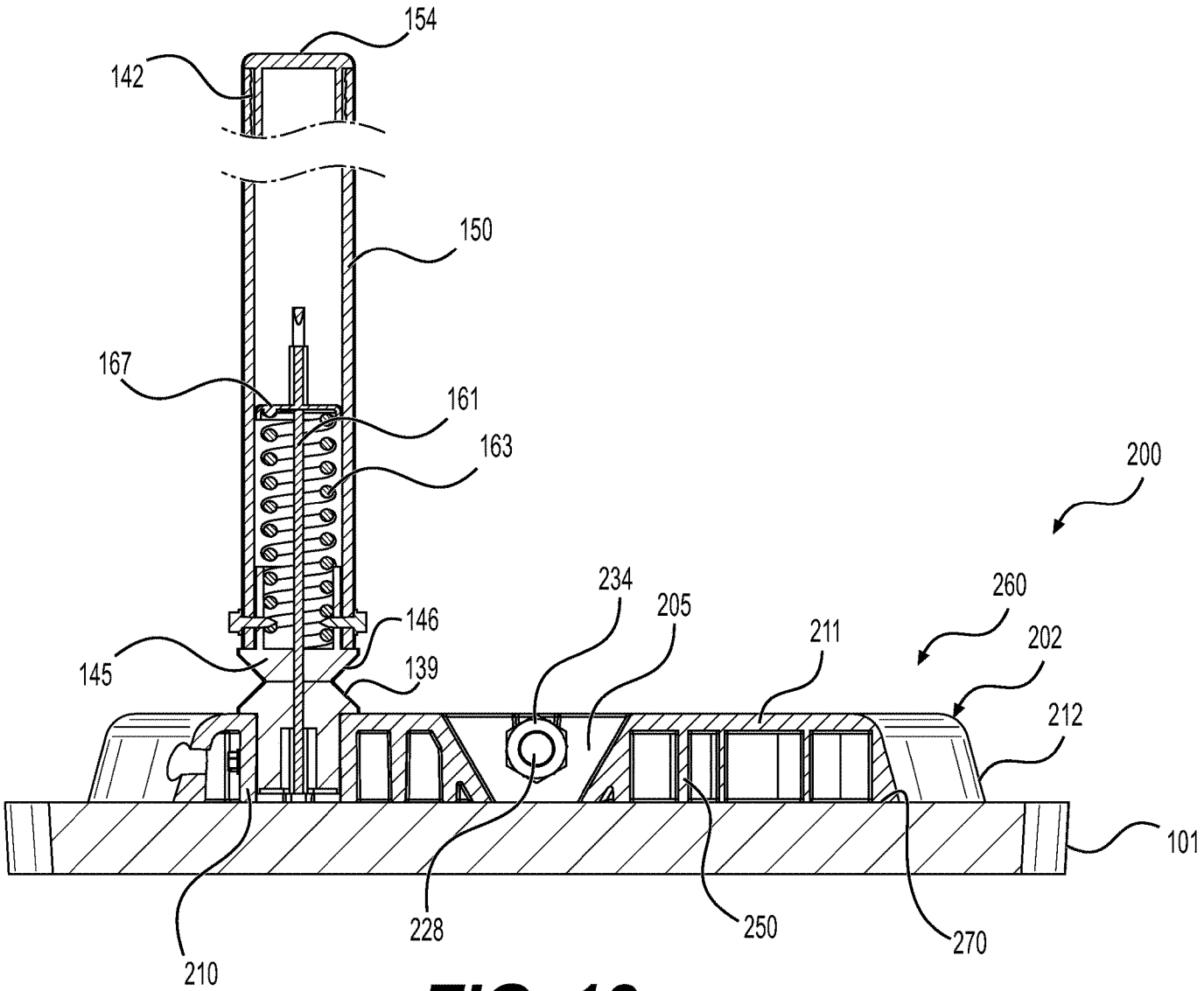
FIG. 13 is a cross-sectional view of the manhole marker assembly and the manhole cover shown in FIG. 11 taken along sight line 13-13, and wherein a portion of the marker is cutaway.
Figure 14:
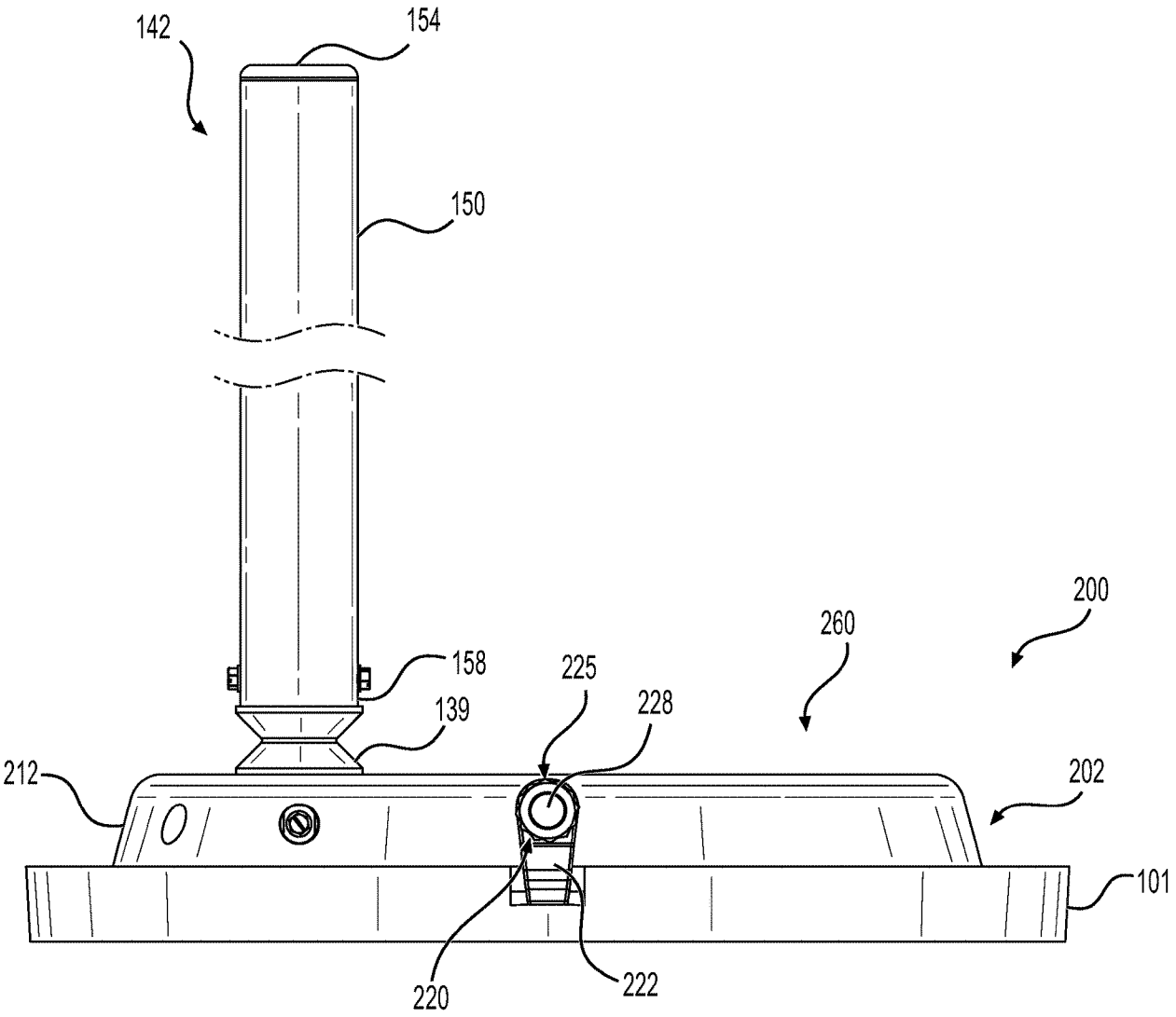
FIG. 14 is a side elevation view of the manhole marker assembly and the manhole cover shown in FIG. 10 with a portion of the marker cutaway.
Figure 15:
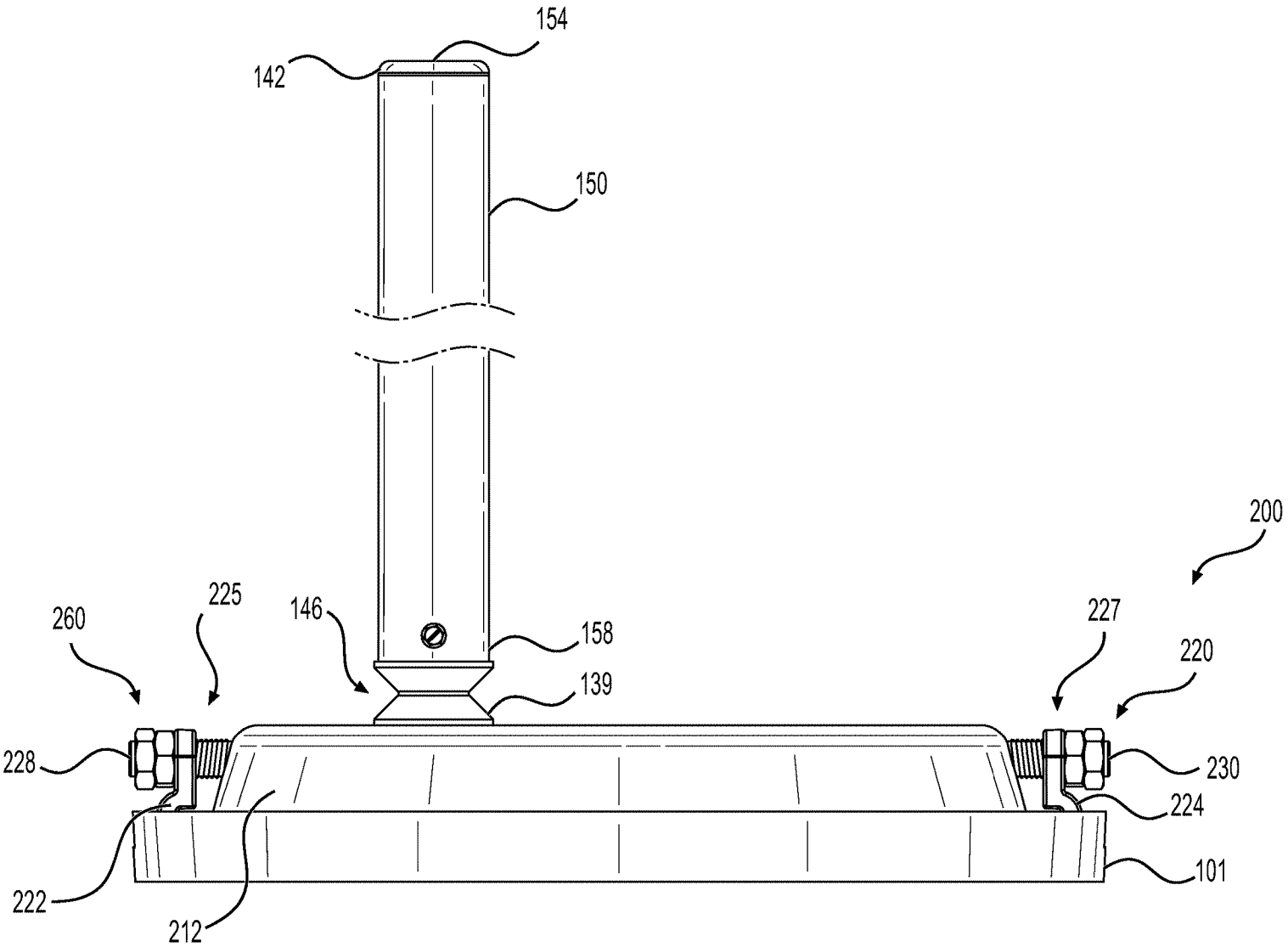
FIG. 15 is another side elevation view of the manhole marker assembly and the manhole cover shown in FIG. 10 with a portion of the marker cutaway.

The marker body 150 of the marker 142 is configured to pivot downward in any direction along a 360° arc from a pivot point located at the marker base 146. As shown in FIG. 13, the marker body 150 comprises a marker body top 154 and a marker body bottom 158. The marker body bottom 158 is aligned proximal to the marker base 146 and the marker assembly base top surface 204, and the marker top 154 is aligned distal to the first marker base 146 and the marker assembly base top surface 204. The marker base 146 comprises a pedestal 139 and a marker pivot assembly 145 operably connected to the pedestal 139. The marker pivot assembly 145 allows for the marker body 150 to pivot multi-directionally. The marker pivot assembly 145 comprises a marker cable 161 that is connected to and extends upward from the pedestal 139. The marker pivot assembly 145 also comprises a pivot base that is movably aligned on and/or above the pedestal 139. The marker pivot assembly 145 further comprises a marker spring 163 seated on the pivot base. The marker cable 161 extends upward through both the pivot base and the marker spring 163. The marker pivot assembly 145 additionally comprises a cable plate 167 seated on the marker spring 163 and to which the marker cable 161 is connected. The marker cable 161 connects the marker pivot assembly 145 to the pedestal 139. The marker body 150 is connected to and/or aligned on the pivot base. At least a portion of the marker spring 163, at least a portion of the marker cable 161, and the cable plate 167 can be disposed in and/or aligned below the marker body 150. The marker cable 161 and the marker spring 163 can be axially aligned with the marker body 150. The pedestal 139 is disposed in and/or engages the marker assembly base 102. As shown in FIG. 14, one or more screws, or other type of fasteners, can be aligned in fastener channels formed in the base skirt 212 of the marker assembly base 202 and used to secure the marker base 146 to the marker assembly base 202.

When a force is applied to a side of a marker body 150, the marker pivot assembly 145 allows the marker body 150 to pivot downward in any direction along a 360° arc. This pivoting of the marker body 150 occurs as a result of the pivot base pivoting relative to the pedestal 139. The pivoting causes the cable plate 167 to compress the marker spring 163. When the force is removed from the marker body 150, the energy stored in the compressed marker spring 163 is released and the marker pivot assembly 145 returns to its original alignment with the pivot base seated on the pedestal 139.

In one aspect, the marker body 150 can exhibit a length in the range of about 0.5 m to about 2.5 m. In another aspect, the marker body 150 can exhibit a length in the range of about 0.75 m to about 2 m. In yet another aspect, the marker body 150 can exhibit a length of approximately 1.5 m, thereby allowing the marker 142 to be visible both near and far from the manhole to which the manhole marker assembly 200 is mounted, when viewed from an elevated position, such as the cab of a vehicle. In yet another aspect, the marker body 150 can be cylindrical. The marker 142 can have indicia formed thereon identifying the particular utility line, lot, unit, or company responsible for the installation or construction.

As shown in FIGS. 10-15, the manhole marker assembly 200 is configured in a manhole cover attached alignment 260, wherein the first jaw 222 and the second jaw 224, and the corresponding teeth 252 formed thereon engage pick notches formed in the manhole cover 101. In the manhole cover attached alignment 260, the manhole marker assembly 200 is securely attached to the manhole cover 101 and cannot be removed therefrom without first threadably realigning one or both of the first jaw rod 228 and the second jaw rod 230, so as to move the first jaw 222 and/or the second jaw 224 away from the marker assembly base 202 and to disengage the first jaw 222 and the second jaw 224 from the pick notches.

Figure 16:
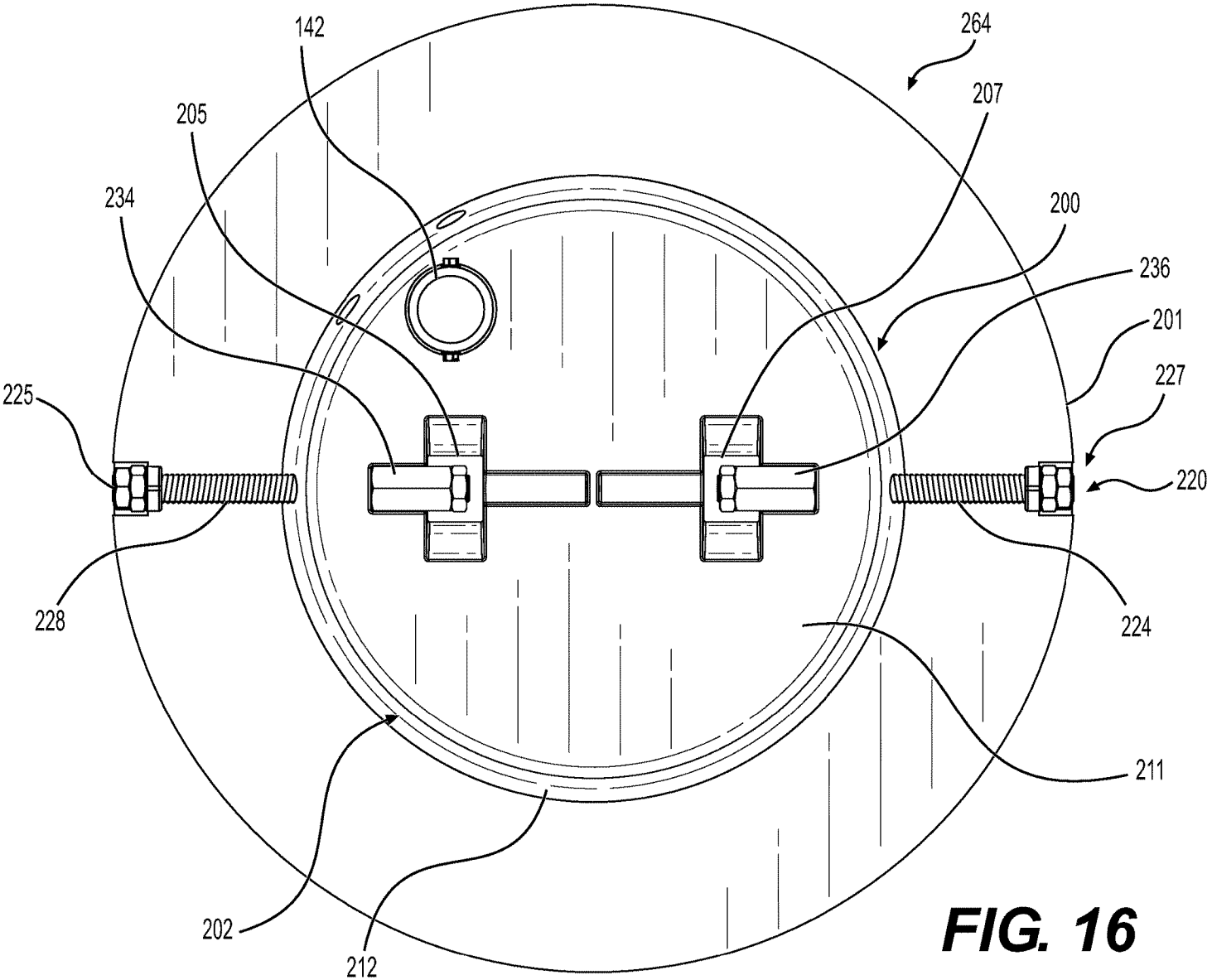
FIG. 16 is a top view of the manhole marker assembly shown in FIG. 10 attached to a large manhole cover in an extended manhole cover attached alignment.

FIG. 16 illustrates the manhole marker assembly 200 usable on manhole covers of varying size. The manhole cover 201 has a larger diameter than the diameter of the manhole cover 101, shown in FIG. 11. The clamp 220 is adjustable, thereby enabling the manhole marker assembly 200 to be mounted and secured to manhole covers with different diameters. The manhole marker assembly 200 is configured in an extended manhole cover attached alignment 264, wherein one or both of the first jaw assembly 225 and the second jaw assembly 227 are adjusted such that the first jaw 222 and/or the second jaw 224 are positioned distal to the marker assembly base 202, thereby allowing the first jaw 222 and the second jaw 230 to engage pick notches disposed adjacent the outer edge of the manhole cover 201. The first jaw assembly 225 is adjusted by threadably moving the first jaw rod 228 outward through the first coupling nut 234, whereby both the outer end of the first jaw rod 228 and the first jaw 222 are aligned farther from the base skirt 212. Likewise, the second jaw assembly 227 is adjusted by threadably moving the second jaw rod 230 outward through the second coupling nut 236, whereby both the outer end of the first jaw rod 228 and the second jaw 224 are aligned farther from the base skirt 212.

Figure 17:
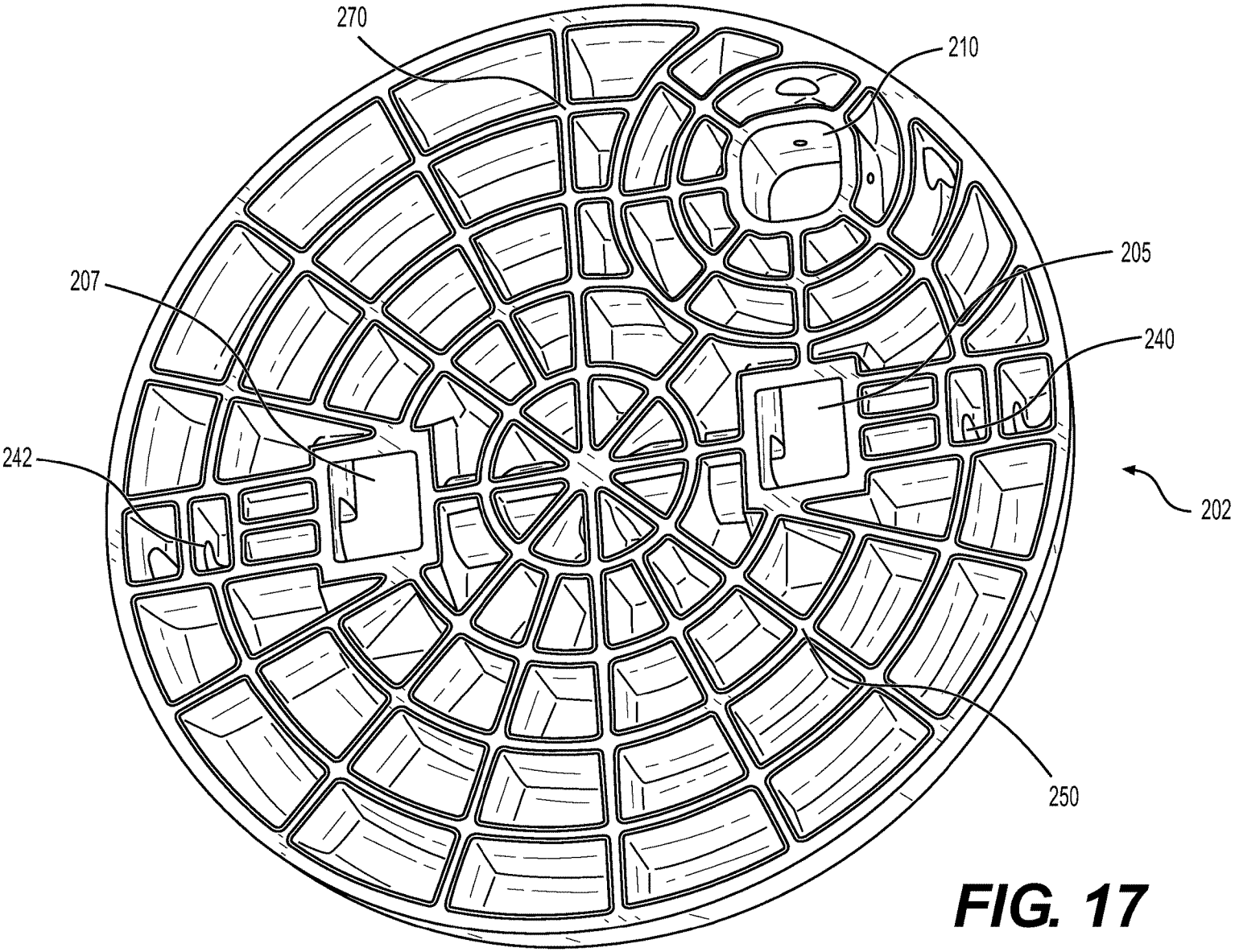
FIG. 17 is a bottom perspective view of the manhole marker assembly base of the manhole marker assembly of FIG. 10 with the other components of the manhole marker assembly removed from the manhole marker assembly base.

FIG. 17 shows the bottom side of the marker assembly base 202. The marker assembly base 202 comprises a plurality of structural ribs 250 that provide strength to the marker assembly base 202 while reducing the overall weight of the marker assembly base 202 as compared to a solid base body. The first base access port 205 and the second base access port 207 extend through the marker assembly base 202 and are open to the bottom of the marker assembly base 202. The marker seat 210 is formed within the marker assembly base 202 and is open to both the top and bottom thereof. The marker seat 210 comprises a plurality of side walls and includes one or more fastener channels formed within the side walls to allow a fastener to be disposed within the fastener channel. The base skirt 212 and the plurality of structural ribs 250 collectively formed a marker assembly base bottom surface 270. The marker assembly base bottom surface 270 contacts the top surface of the manhole cover 101 in the manhole cover attached alignment 260.

Each of the manhole marker assemblies 100 and 200 can exhibit a total height in the range of about 160 cm to about 165 cm. In one aspect, each of the manhole marker assemblies 100 and 200 can exhibit a total height of about 161 cm. Each of the marker assembly bases 102 and 202 can exhibit a height in the range of about 4 cm to about 6.5 cm. In another aspect, each of the marker assembly bases 102 and 202 can exhibit a height of about 4.7 cm. In still another aspect, each of the marker assembly bases 102 and 202 can exhibit a height of about 6.3 cm.

The components of the manhole marker assembly 100 and 200 can be formed from various materials have sufficiently high elastic modulus and high compressive, flexural and impact strength and can include, but are not limited to, metal, such as cast iron and steel, concrete, ceramic, high density polymers and combinations thereof. In one aspect, the parts of the manhole marker assemblies 100 and 200 can be formed of one or more polymers or monomeric moieties including, but not limited to, polycarbonate, polyimide, acetal copolymer, polyamide-imide, polyethylene terephthalate, acrylic, ultra high density polyethylene, fiber reinforced polymers, monomers, copolymers and combinations thereof. Other components of the manhole marker assemblies 100 and 200, such as the clamps, jaw assemblies, jaw rods, coupling nuts, turnbuckles, screws, springs, and nuts can be formed of any one or more of aluminum, stainless steel, galvanized steel, copper, carbon steel and/or brass.

The alignments and configurations of the parts of the manhole marker assembly disclosed herein can be varied without departing from the scope of the present disclosure. The manhole marker assemblies encompassed by the present disclosure can include overall heights that vary from the examples. Other embodiments of the manhole marker assembly set forth in the present disclosure will be apparent to those skilled in the art from their consideration of the specification and practice of the present disclosure disclosed in this document. It is intended that the specification and examples be considered as exemplary only, with the true scope and spirit of the present disclosure being indicated by the following claims.

The invention claimed is:

1. A manhole marker assembly for identifying a manhole, the manhole marker assembly comprising:

a marker assembly base comprising a base top deck, a base skirt depending from the base top deck, and a plurality of structural ribs depending from the base top deck;

a marker mounted to the marker assembly base, wherein the marker extends upward beyond the marker assembly base top deck; and, a plurality of jaws mounted to the marker assembly base, wherein the plurality of jaws comprises a first jaw and a second jaw, wherein each of the first jaw and the second jaw extends downward beyond the marker assembly base skirt, wherein at least one of the first jaw and the second jaw are movable, wherein the manhole marker assembly is movable between a manhole cover attached alignment and a manhole cover detached alignment, wherein the manhole marker assembly is attached to a manhole cover in the manhole cover attached alignment, wherein the marker assembly base skirt is aligned over a manhole cover in the manhole cover attached alignment, and wherein the first jaw and the second jaw engage the manhole cover in the manhole cover attached alignment.

2. The manhole marker assembly of claim 1, wherein the first jaw is movably connected to the second jaw by a turnbuckle.

3. The manhole marker assembly of claim 1, wherein the first jaw and the second jaw are movable.

4. The manhole marker assembly of claim 1, wherein the first jaw comprises a tooth.

5. The manhole marker assembly of claim 1, wherein the marker assembly base is disposed between the first jaw and the second jaw.

6. The manhole marker assembly of claim 1, wherein the marker is pivotally movable.

7. The manhole marker assembly of claim 6, wherein the marker comprises a spring.

8. The manhole marker assembly of claim 1, wherein the marker is aligned above the manhole cover in the manhole cover attached alignment.

9. The manhole marker assembly of claim 1, wherein the marker assembly base comprises a movable top plate.

10. A manhole marker assembly for attaching to a manhole cover and marking a manhole, the manhole marker assembly comprising:

a marker assembly base, wherein the marker assembly base comprises a base top deck and a base skirt depending from the base top deck, and a plurality of structural ribs depending from the base top deck;

a marker mounted to the marker assembly base, wherein the marker comprises a marker body, wherein the marker body is elongated, wherein the marker body comprises a marker body top and a marker body bottom, wherein the marker body top is aligned distal to the marker assembly base and the marker body bottom is aligned proximal to the marker assembly base, and wherein the marker body is pivotally movable; and, a clamp mounted to the marker assembly base, wherein the clamp comprises a first jaw assembly mounted to the marker assembly base and a second jaw assembly mounted to the marker assembly base, wherein the first jaw assembly comprises a first jaw and the second jaw assembly comprises a second jaw, wherein the first jaw and the second jaw are movable.

11. The manhole marker assembly of claim 10, wherein the first jaw and the second jaw are extendable from the marker assembly base.

12. The manhole marker assembly of claim 11, wherein the first jaw assembly comprises a first jaw rod movably connected to the marker assembly base, and wherein the first jaw is mounted on the first jaw rod.

13. The manhole marker assembly of claim 12, wherein the first jaw rod is aligned in a jaw rod channel formed in the marker assembly base.

14. The manhole marker assembly of claim 13, wherein the first jaw assembly comprises a coupling nut threadably attached to the first jaw rod.

15. The manhole marker assembly of claim 10, wherein the first jaw is aligned opposing the second jaw, and wherein the marker assembly base is aligned between the first jaw and the second jaw.

16. The manhole marker assembly of claim 10, wherein the first jaw comprises a first tooth and the second jaw comprises a second tooth.

17. The manhole marker assembly of claim 10, wherein the clamp comprises a turnbuckle connecting the first jaw assembly to the second jaw assembly.

18. The manhole marker assembly of claim 10, wherein the marker comprises a marker pivot assembly, wherein the marker pivot assembly comprises a marker spring operably connected to the marker body.

19. A manhole marker assembly for attaching to a manhole cover and marking a manhole, the manhole marker assembly comprising:

a marker assembly base comprising a base top deck, a base skirt depending from the base top deck, a plurality of structural ribs depending from the base top deck, and wherein the base skirt is frustoconical;

a marker mounted to the marker assembly base, wherein the marker comprises a marker body, wherein the marker body comprises a marker body top and a marker body bottom, wherein in the marker body top is aligned distal to the base top deck and the marker body bottom is aligned proximal to the base top deck, wherein the marker comprises a marker pivot assembly, wherein the marker body is mounted to the marker pivot assembly, wherein the marker body is pivotally movable on the marker pivot assembly; and, a clamp mounted to the marker assembly base, wherein the clamp comprises a first jaw assembly and a second jaw assembly, wherein the first jaw assembly comprises a first jaw mounted on a first jaw rod, wherein the first jaw rod is movably aligned within a first jaw rod channel formed in the marker assembly base, wherein the second jaw assembly comprises a second jaw mounted on a second jaw rod, wherein the second jaw rod is movably aligned within a second jaw rod channel formed in the marker assembly base, wherein the first jaw rod is adjustably extendable from the first jaw rod channel, and wherein the second jaw rod is adjustably extendable from the second jaw rod channel.

* * * * *